US010113733B1

(12) United States Patent
Hung

(10) Patent No.: US 10,113,733 B1
(45) Date of Patent: Oct. 30, 2018

(54) CONNECTOR FOR LIGHT FIXTURE

(71) Applicant: Huiyang Zing Ear Industry Co., Ltd., Huizhou, Guangdong Province (CN)

(72) Inventor: Tang-Yueh Hung, Huizhou (CN)

(73) Assignee: HUIYANG ZING EAR INDUSTRY CO., LTD., Huizhou (CN)

( * ) Notice: Subject to any disclaimer, the term of this patent is extended or adjusted under 35 U.S.C. 154(b) by 0 days.

(21) Appl. No.: 15/866,238

(22) Filed: Jan. 9, 2018

(51) Int. Cl.

| | |
|---|---|
| ***F21V 21/16*** | (2006.01) |
| ***F21V 23/06*** | (2006.01) |
| ***F21S 8/06*** | (2006.01) |
| ***F21V 21/088*** | (2006.01) |
| ***F21V 21/35*** | (2006.01) |
| ***F21V 23/00*** | (2015.01) |

(52) U.S. Cl.
CPC ..... *F21V 23/06* (2013.01); *F21S 8/06* (2013.01); *F21V 21/088* (2013.01); *F21V 21/35* (2013.01); *F21V 23/002* (2013.01)

(58) Field of Classification Search
CPC ..... F21V 23/06; F21V 23/002; F21V 21/35; F21V 21/088; F21S 8/06
See application file for complete search history.

(56) References Cited

U.S. PATENT DOCUMENTS

2004/0036570 A1* 2/2004 Yu ..... H01H 73/26 337/59
2010/0039209 A1* 2/2010 Hung ..... H01H 23/025 337/66
2015/0092449 A1* 4/2015 Demuynck ..... H05B 33/0803 362/649

* cited by examiner

*Primary Examiner* — Evan Dzierzynski
(74) *Attorney, Agent, or Firm* — Guice Patents PLLC

(57) ABSTRACT

A connector for a light fixture, including: a housing; at least two jacks, disposed at an end of the housing; a first conductive sheet and a second conductive sheet, where a coupling end and a contact end are respectively formed at two ends of each conductive sheet, each coupling end has an clamping sheet, the two conductive sheets are disposed in the housing, the two coupling ends correspond to the two jacks, and when an electrical wire is inserted in each of the jacks, the electrical wire is clamped by a clamping sheet; and two wire release buttons disposed at the housing and being displaceable, where the two wire release buttons respectively correspond to the coupling ends of the two conductive sheets, and when the two wire release buttons are pressed, the two clamping sheets may be pushed, to release a state in which the two clamping sheets clamp the electrical wire.

15 Claims, 21 Drawing Sheets

CONNECTOR FOR LIGHT FIXTURE

BACKGROUND OF THE INVENTION

1. Field of the Invention

The present invention relates to light fixtures, and in particular, to a connector used for a ceiling light.

2. Description of the Related Art

Various types of light fixtures may be installed at different indoor and outdoor locations. A ceiling light is a light fixture installed on the ceiling to provide indoor lighting. A ceiling light is installed at a high position, and the installation is relatively dangerous and inconvenient. To install or dismantle a ceiling light at a high position, it is not easy to connect the light fixture to an electrical wire on the ceiling or disconnect the light fixture from the electrical wire. If a ceiling light can be conveniently connected to or dismantled from an electrical wire, it becomes easy to disassemble or assemble the ceiling light.

SUMMARY OF THE INVENTION

An object of the present invention is to provide a connector for a light fixture, making it more convenient to install or dismantle a light fixture.

A connector for a light fixture provided in the present invention includes:

a housing, an installation space being formed in the housing; at least two jacks disposed at an end of the housing; a guide portion disposed on a wall surface of the housing;

a first conductive sheet and a second conductive sheet, where a coupling end and a contact end are respectively formed at two ends of each conductive sheet, each coupling end has an elastically swingable clamping sheet, the two conductive sheets are disposed in the installation space of the housing, the two coupling ends correspond to the two jacks, an end of each clamping sheet extends obliquely in a direction away from each jack, when an electrical wire is inserted in each of the jacks, the electrical wire is clamped by a clamping sheet, and the two contact ends are located at the guide portion; and two wire release buttons disposed at the housing and being displaceable, where the two wire release buttons respectively correspond to the coupling ends of the two conductive sheets, and when the two wire release buttons are pressed, the two clamping sheets may be pushed, to release a state in which the two clamping sheets clamp the electrical wire.

Preferably, each wire release button is provided with a push portion, and each clamping sheet is pushed by the push portion.

Preferably, the housing is provided with two through holes, respectively corresponding to the two coupling ends, and the two wire release buttons are respectively installed in the two through holes, and are displaceable in the two through holes.

Preferably, the guide portion is an inner annular groove and an outer annular groove concentrically disposed on a circumferential surface of the housing, and the contact ends of the two conductive sheets are respectively located in the inner annular groove and the outer annular groove.

Preferably, the guide portion is two penetration holes disposed at an end of the housing, and the contact ends of the two conductive sheets respectively correspond to the two penetration holes.

In this way, by means of the connector, it is easy to connect or disconnect an electrical wire of a light fixture, making it convenient to install or dismantle the light fixture, and making it more convenient to install the light fixture at a high position. Moreover, the connector may be installed on a lamp panel, and the light fixture is easily fixed on the lamp panel and may be electrically connected to the connector conveniently.

BRIEF DESCRIPTION OF THE DRAWINGS

The objectives, features, and effects of the present invention may be understood by using the following description of the preferred embodiments and accompanying drawings, where.

DETAILED DESCRIPTION OF THE PREFERRED EMBODIMENTS

Figure 3:
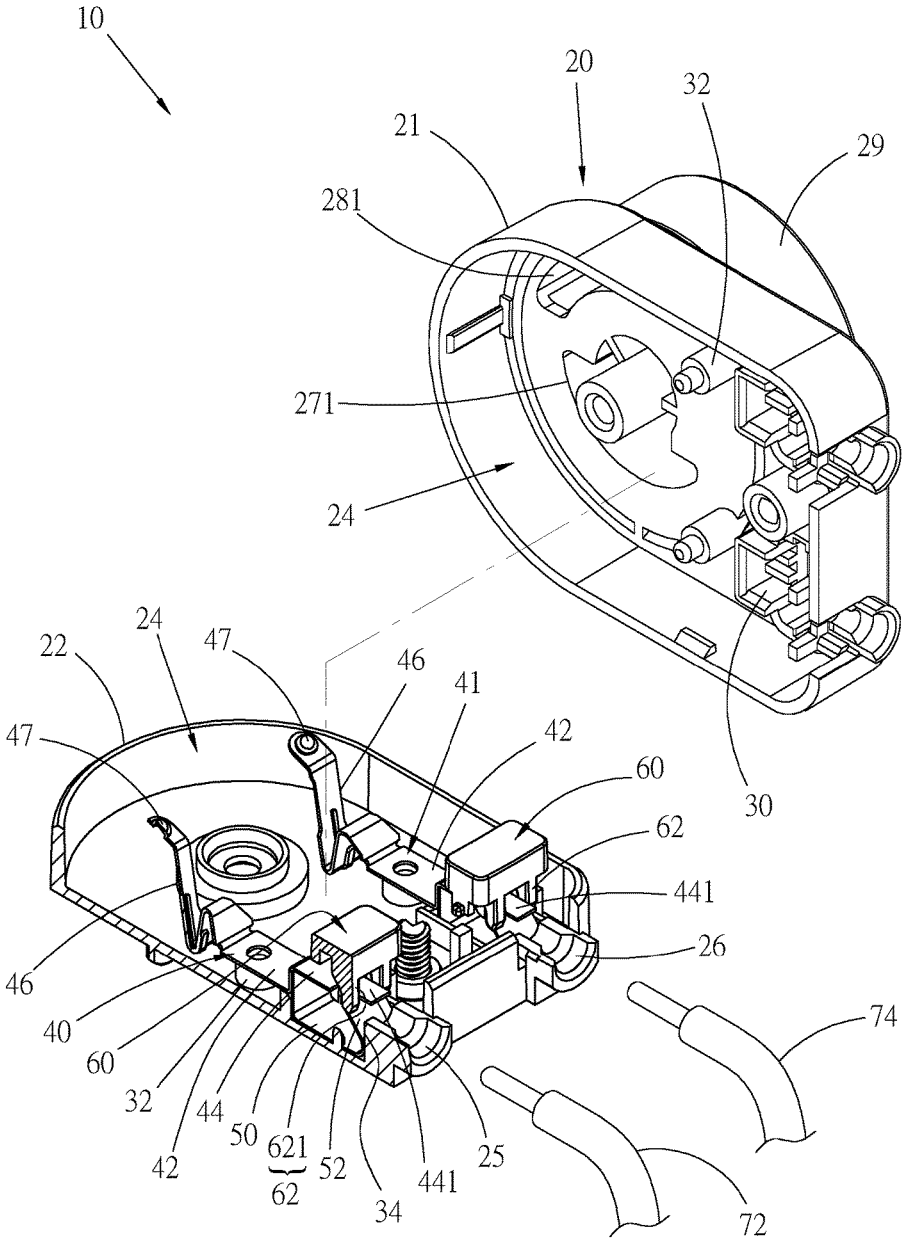
FIG. 3 is a partial three-dimensional exploded view of FIG. 1.
Figure 5:
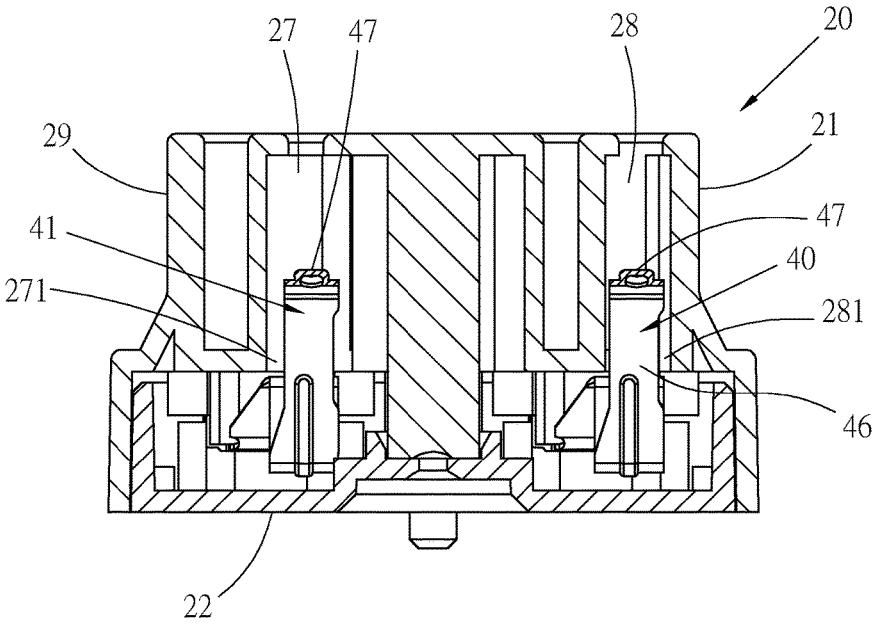
FIG. 5 is a sectional view along a sectional line 5-5 in FIG. 1.

Referring to FIG. 1 to FIG. 4, FIG. 1 to FIG. 4 show a connector 10 provided in a first preferred embodiment of the present invention. The connector 10 is applicable to various light fixtures, and is especially applicable to a ceiling light. The connector 10 includes:

A housing 20 is formed of an upper housing 21 and a lower housing 22 fitting each other. The upper housing and the lower housing are separable. An installation space 24 is formed between the upper housing 21 and the lower housing 22. Two jacks 25, 26 are disposed at an end of the housing 20 and are connected to the installation space 24. An inner annular groove 27 and an outer annular groove 28 are concentrically formed on a front surface 201 of the housing 20 (a front surface of the upper housing 21). The two annular grooves 27, 28 are formed between several concentrically disposed circular convex walls 29. Referring to FIG. 3 and FIG. 5, the inner annular groove 27 is connected to the installation space 24 through a hollow portion 271 at an inner end of the inner annular groove 27, and the outer annular groove 28 is connected to the installation space 24 through a hollow portion 281 at an inner end of the outer annular groove 28. Two through holes 30 are disposed on a circumferential surface, for example, the front surface 201, of the housing 20, and are connected to the installation space 24.

Figure 1:
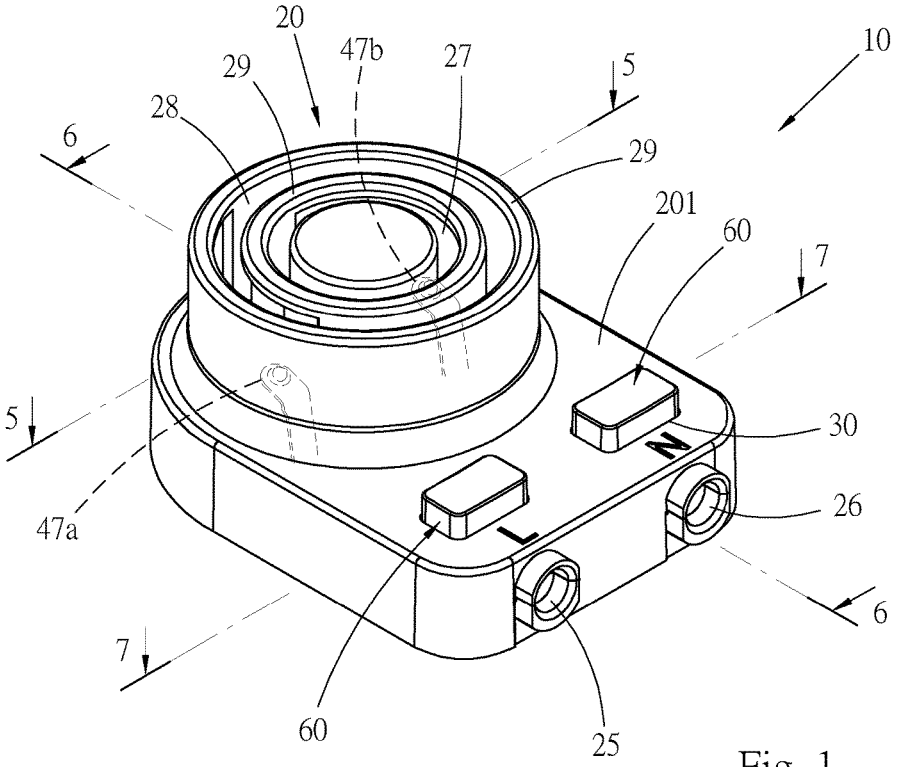
FIG. 1 is a three-dimensional front view of a connector according to a first preferred embodiment of the present invention.
Figure 2:
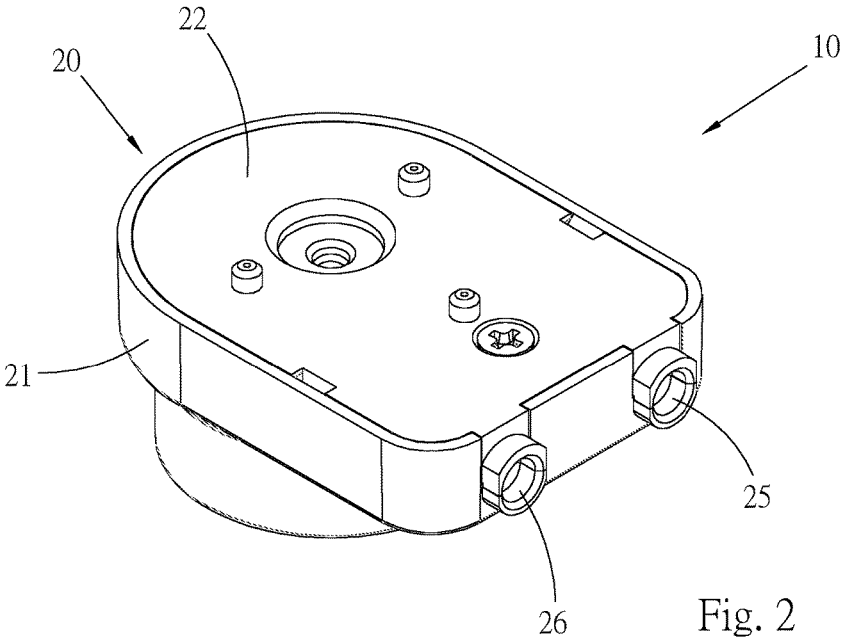
FIG. 2 is a three-dimensional rear view of FIG. 1.

A first conductive sheet 40 and a second conductive sheet 41 are made of metal and have a same configuration. Each conductive sheet 40 or 41 has a body portion 42. A coupling end 44 and a contact end 46 are respectively formed at two ends of the body portion 42. The body portions 42 of the two conductive sheets 40, 41 are respectively fixed at two fixing columns 32 located inside the installation space 24. The two coupling ends 44 are respectively directly opposite inner ends of the two jacks 25, 26. Each coupling end 44 has an elastically swingable clamping sheet 52, so as to clamp an electrical wire. In this embodiment, the clamping sheet 52 is provided by a clamping member 50 in the following. Each contact end 46 extends outwardly from an end of the body portion 42 in a manner of multiple bends, so that a configuration design of multiple arcs is formed for the contact end to obtain highly desirable elasticity. The configuration of multiple arcs is a configuration of multiple bends, and in this embodiment, the configuration includes: one small-angle bend 461 and at least two large-angle bends 462, 463. Each contact end 46 has a contact 47. A contact 47*a* of the first conductive sheet 40 extends into the outer annular groove 28 through the hollow portion 281 of the upper housing 21, as shown in FIG. 1, and a contact 47*b* of the second conductive sheet 41 extends into the inner annular groove 27 through the hollow portion 271 (for ease of recognition of the contacts of the two conductive sheets, in some figures, numerals 47*a* and 47*b* are used for representation). The two annular grooves 27, 28 form a guide portion of the housing, and the two contact ends 46 are located at the guide portion.

Figure 6:
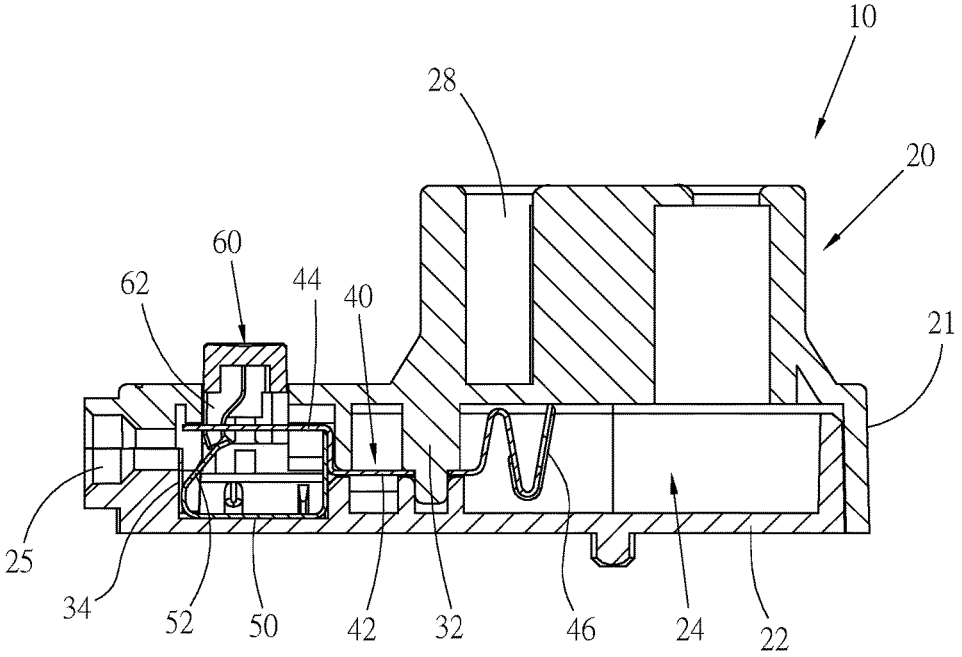
FIG. 6 is a sectional view along a sectional line 6-6 in FIG. 2.

Two clamping members 50 are sheet bodies made of metal and have a same configuration. The two clamping members 50 are respectively installed in two receiving grooves 34 formed inside the installation space 24, as shown in FIG. 3 and FIG. 6, are located at the inner ends of the two jacks 25, 26, and correspond to the coupling ends 44 of the two conductive sheets 40, 41. The foregoing elastically swingable clamping sheet 52 is formed on the clamping member 50. An end (a free end) of the clamping sheet 52 extends obliquely in a direction away from each jack, and extends toward the coupling ends 44. The clamping sheet 52 is elastically displaceable when being pressed.

Figure 4:
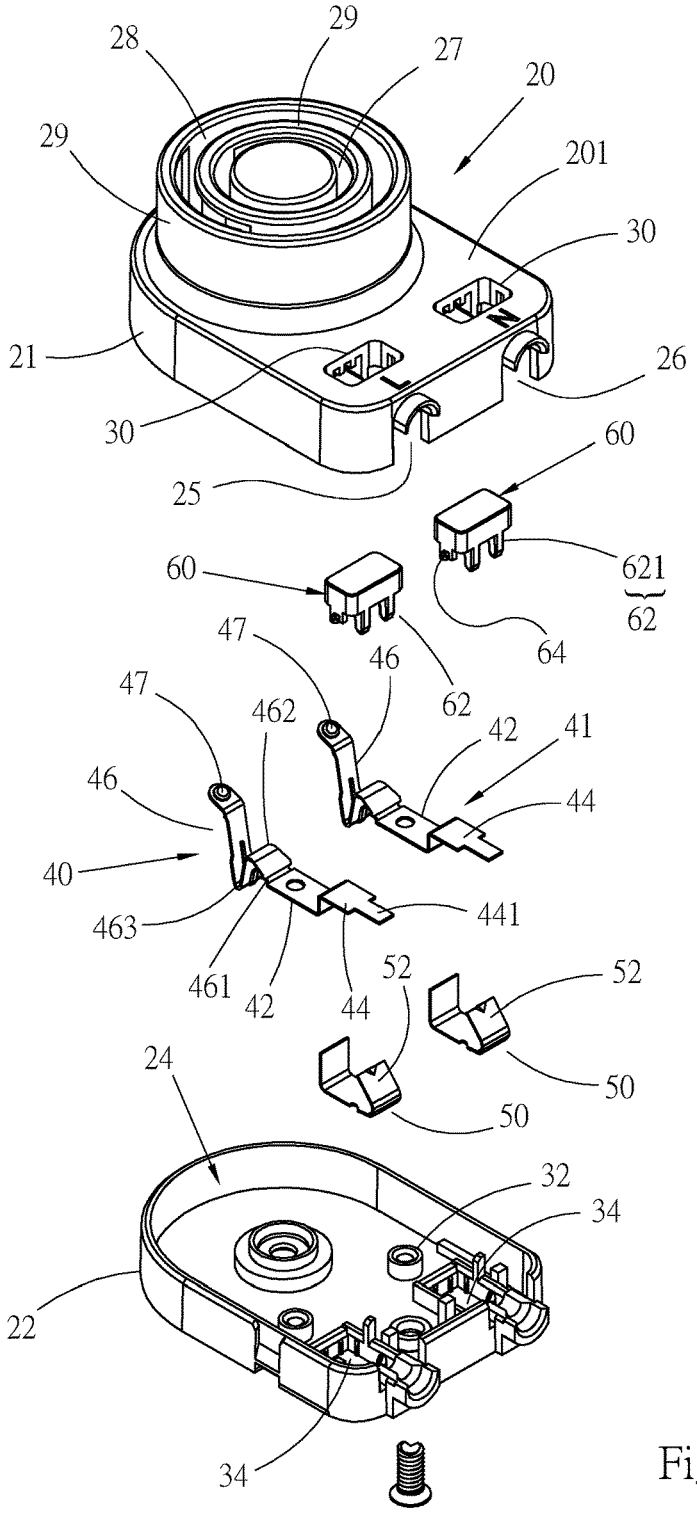
FIG. 4 is a three-dimensional exploded view of FIG. 1.
Figure 7:
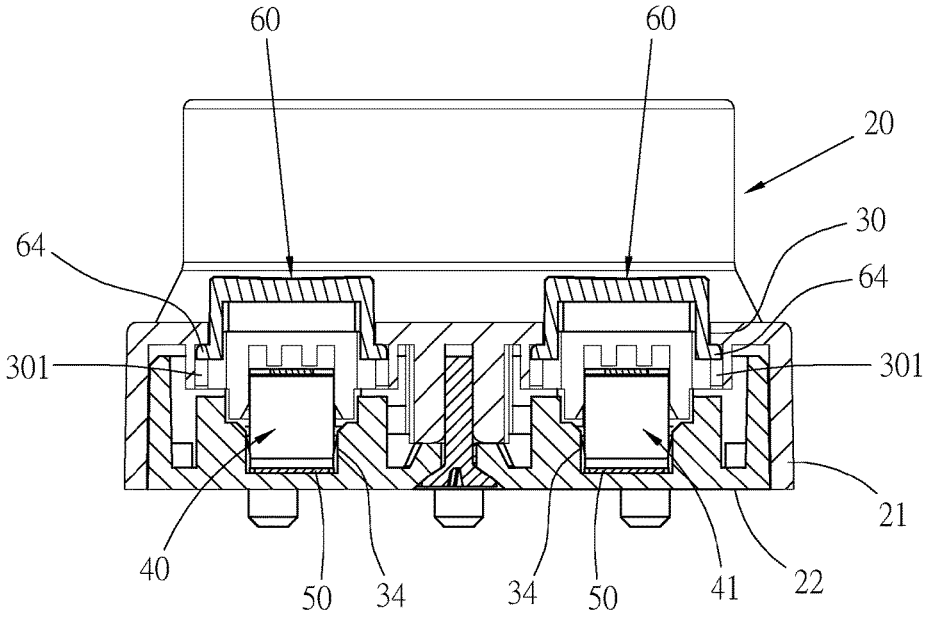
FIG. 7 is a sectional view along a sectional line 7-7 in FIG. 1.

Two wire release buttons 60 are installed in the two through holes 30 of the housing 20, and are displaceable, so as to push the clamping sheets 52 of the two clamping members 50 to leave the coupling ends 44. In this embodiment, each coupling end 44 is located between each clamping member 50 and each wire release button 60, and the coupling end 44 has a portion 441 with a relatively small width. Each wire release button 60 has a push portion 62, directions in FIG. 3 and FIG. 4 are used as references, the push portion 62 has a fork form formed of two feet 621, and the wire release button extends downwardly. The two wire release buttons 60 are accommodated in the two through holes 30 and are vertically displaceable. The two feet 621 of the push portion 62 span a narrow portion 441 of the coupling end 44, as shown in FIG. 3, and may be held against the clamping sheet 52 of the clamping member 50. Therefore, when the wire release button 60 is pressed, the clamping sheet 52 may be pushed downwardly through the push portion 62, and the coupling ends 44 of the conductive sheets are not pushed. When the clamping sheet 52 is not pressed by the wire release button 60, the clamping sheet 52 is elastically restored. Referring to FIG. 7, bosses 64 disposed on two sides of the wire release button 60 are inserted in grooves 301 disposed on two sides of each through hole 30, and the bosses 64 are constrained by top ends of the grooves 301, so that the wire release button 60 does not move upward to leave the through hole 30. It may be understood that different implementation structures may be used to enable the push portion of the wire release button 60 to move across the coupling ends 44 to come into contact with the clamping sheet 52. Only one structure is disclosed in this embodiment, and the present invention is not limited thereto.

Figure 8:
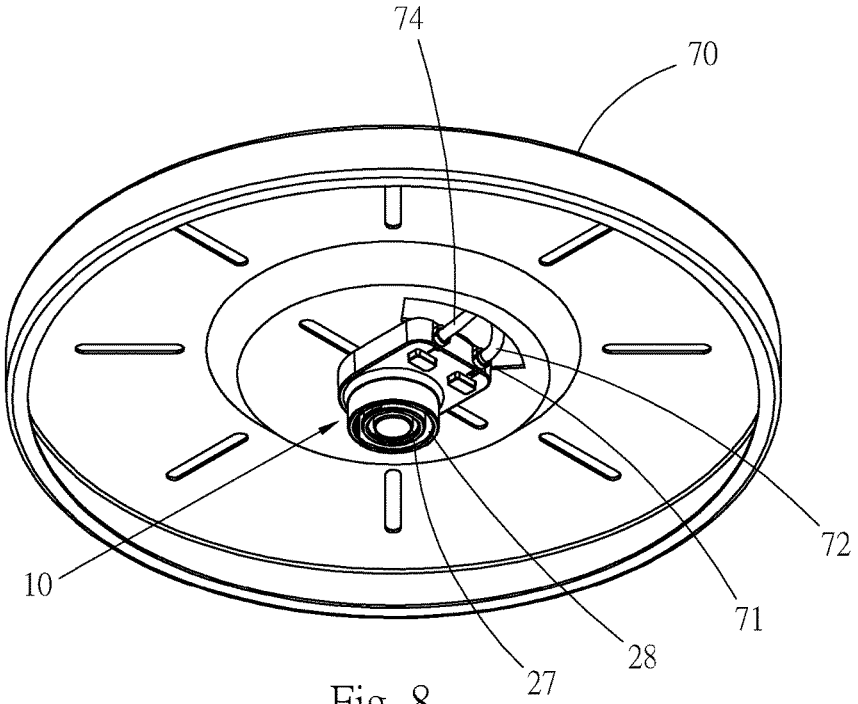
FIG. 8 is a three-dimensional bottom view of a lamp panel, where the connector in FIG. 1 is installed on the lamp panel.
Figure 9:
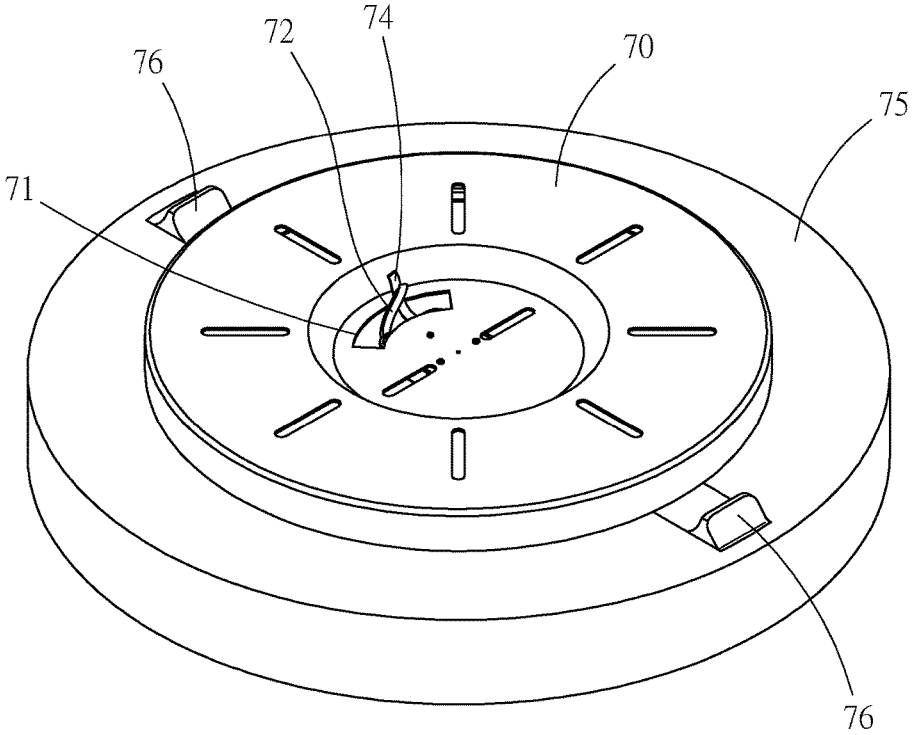
FIG. 9 is a three-dimensional top view of a light fixture being installed on the lamp panel.

Referring to FIG. 8, the connector 10 is installed on a circular lamp panel 70. The inner annular groove 27 and the outer annular groove 28 are concentric with the lamp panel. During the installation of a light fixture, the lamp panel 70 is fixed on a wall surface. If the installed light fixture is a ceiling light, the lamp panel 70 is fixed on the ceiling, and two electrical wires 72, 74 pass through an opening 71 of the lamp panel 70 and are inserted in the connector 10. Then, as shown in FIG. 9, a light fixture 75 is sleeved over the lamp panel 70, and a fastener 76 of the light fixture 75 fastens the lamp panel 70, so as to fix the light fixture. Positive and negative conductive members of the light fixture are located at the center of the lamp panel 70, and extend into the inner annular groove 27 and the outer annular groove 28 to come into contact with the contacts 47 of the two conductive sheets 40, 41, thereby transmitting power. By means of this design, the light fixture 75 may be connected to the lamp panel 70 at any angle and accomplish the transmission of power, and the angle of the light fixture 75 does not need to be deliberately adjusted or calibrated.

Figure 10:
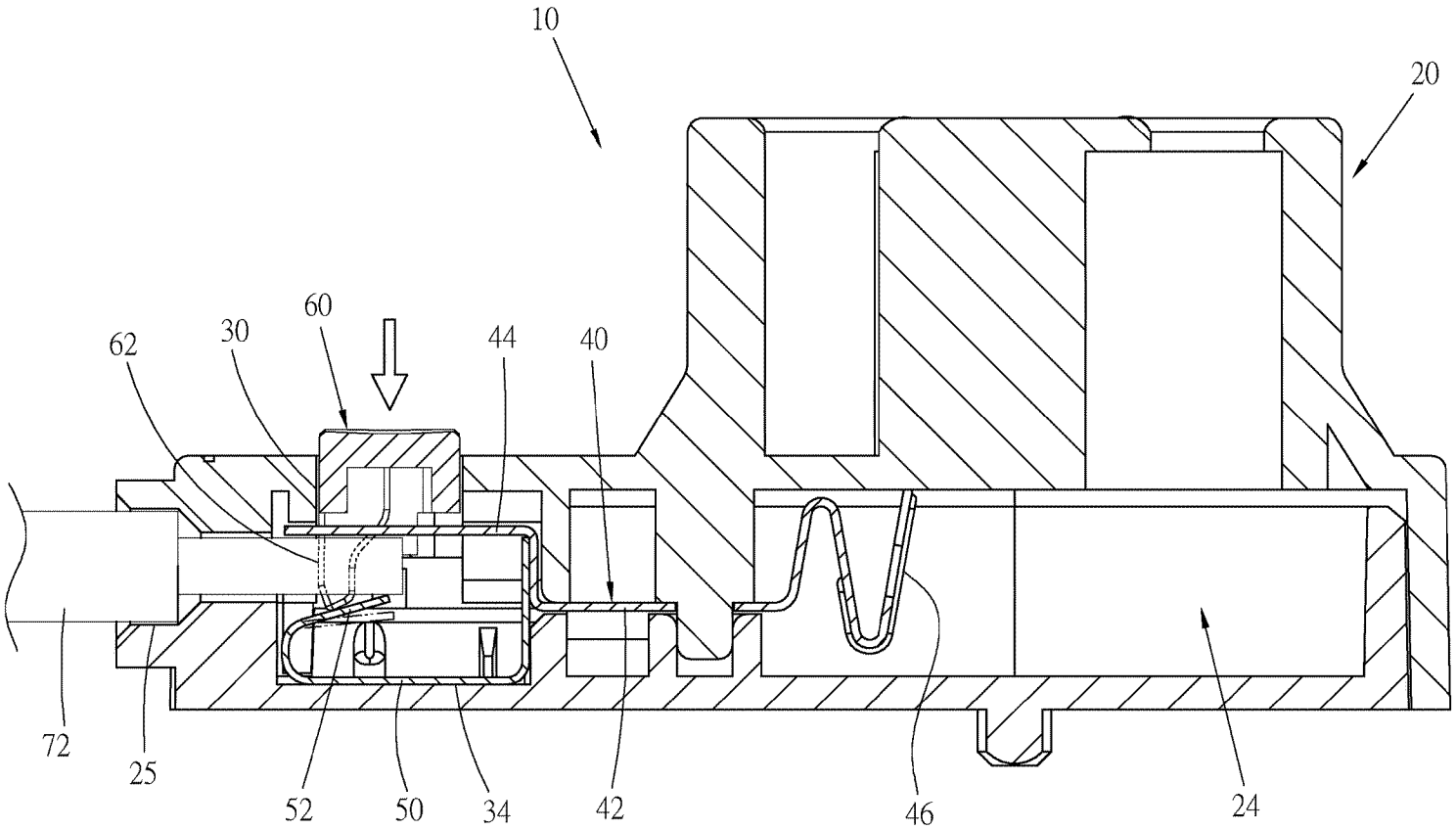
FIG. 10 is basically the same as FIG. 6, and shows a sectional view after an electrical wire is inserted in the connector.

When the foregoing two electrical wires are inserted in the connector 10, referring to FIG. 10, an example in which the electrical wire 72 is inserted through the jack 25 is used. After the electrical wire 72 is inserted in the jack 25, and the clamping sheet 52 of the clamping member 50 is pressed, making the clamping sheet 52 elastically swing to allow the electrical wire 72 to enter and come into contact with the coupling end 44 of the first conductive sheet 40 and the clamping sheet 52. The conductive sheet 40 is electrically connected to the electrical wire 72. The electrical wire 72 is clamped by the clamping sheet 52 and cannot be detached from the connector 10.

When an electrical wire needs to be dismantled to dismantle the light fixture 75, an operator only needs to press each wire release button 60, and the push portion 62 is used to push the clamping sheet 52 away from the electrical wire 72, as shown by the phantom line in FIG. 10, so that a state in which the clamping sheets 52 clamp the electrical wire 72 is released, so that the electrical wire can be easily pulled out from the jack 25 and is separated from the connector. Therefore, it is highly convenient to detach an electrical wire from the connector. For the connector of the present invention, no tool needs to be used to connect or disconnect an electrical wire.

Figure 11:
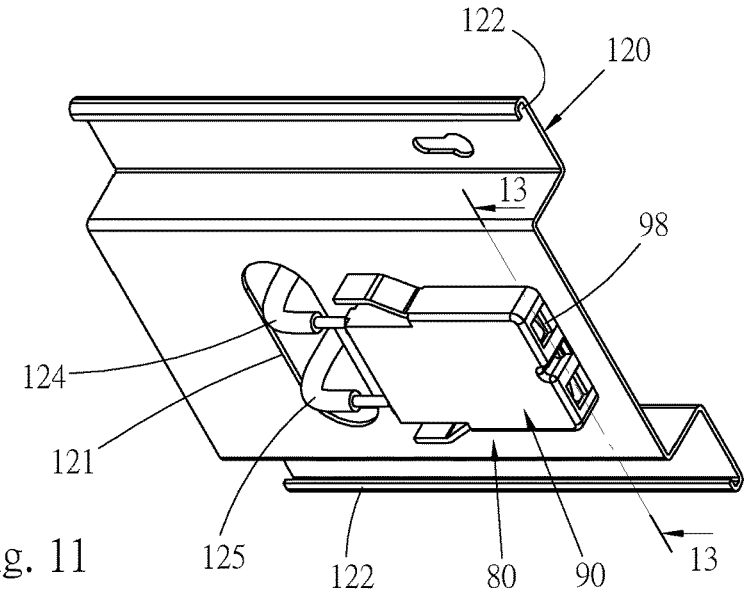
FIG. 11 is a three-dimensional view of a connector according to a second preferred embodiment of the present invention, and shows the connector being installed on a lamp panel.
Figure 12:
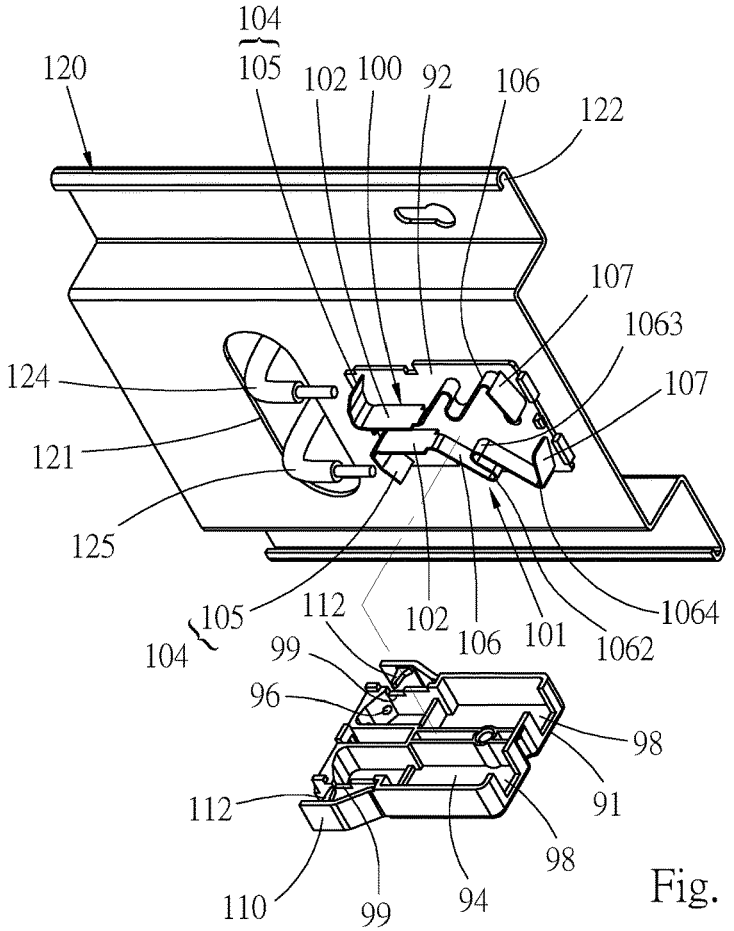
FIG. 12 is a three-dimensional exploded view of a large portion of FIG. 11.

FIG. 11 and FIG. 12 show a connector 80 according to a second preferred embodiment of the present invention. The connector 80 includes: a housing 90, a first conductive sheet 100, a second conductive sheet 101, and two wire release buttons 110. The figures also show that the connector 80 is installed on a lamp panel 120. The figures in this embodiment and a third preferred embodiment and a fourth preferred embodiment in the following show a viewing angle at which the connector 80 and the lamp panel 120 are installed on the ceiling.

The housing 90 is also formed of an upper housing 91 and a lower housing 92 fitting each other, and an installation space 94 is formed between the upper housing and the lower housing. Two jacks 95, 96 are disposed at an end of the housing 90 and are connected to the installation space 94. Two penetration holes 98 are disposed at the other end of the housing 90 and are connected to the installation space 94. Two through holes 99 are provided on circumferential walls on two sides of the housing 90, are connected to the installation space 94, and correspond to the two jacks 95, 96. A rear surface of the lower housing 92 is connected to the lamp panel 120.

The two conductive sheets 100, 101 have a same configuration. The conductive sheet 100 is used for description. The conductive sheet 100 has a body portion 102 and a coupling end 104 and a contact end 106 located at two ends of the body portion. The two conductive sheets 100, 101 are symmetrically disposed in the installation space 94. The two coupling ends 104 are respectively directly opposite inner ends of the two jacks 95, 96. Each coupling end 104 is provided with an elastic clamping sheet 105. An end of the clamping sheet 105 extends obliquely from the body portion 102 in a direction away from each jack, and is elastically displaceable when being pressed. Each contact end 106 extends outwardly in a manner of multiple bends from an end of the body portion 102, to form a configuration design of multiple arcs and obtain highly desirable elasticity. The multiple bends include: one small-angle bend 1061 and at least two large-angle bends, including three large bends 1062 to 1064. A contact 107 is formed at an end tip of each contact end 106. The two contacts 107 correspond to the two penetration holes 98. The two penetration holes 98 form a guide portion of the housing. The two contact ends 106 are located at the guide portion.

The two wire release buttons 110 are disposed on two s ides of the housing 90 and may displace when being pressed. In this embodiment, the two wire release buttons 110 are integrally formed with the upper housing 91 and are elastically displaceable. An end of each wire release button 110 is connected to the housing. The other end of the wire release button 110 is a free end. Each wire release button 110 is provided with a columnar push portion 112. The two push portions 112 respectively correspond to the two through holes 99. When the two wire release buttons 110 are pressed, the two push portions 112 may extend into the installation space of the housing 94 through the two through holes 99, to push the clamping sheets 105 of the two conductive sheets 100, 101.

The connector 80 is installed on the lamp panel 120, and the two penetration holes 98 face an end of the lamp panel 120. The lamp panel 120 is fixed on a wall surface, for example, the ceiling, so as to fix a light fixture (not shown), for example, a ceiling light, on the lamp panel 120. The light fixture is embedded, in a slideable manner from an end of the lamp panel, in two parallel insertion slots 122 disposed on two sides of the lamp panel. In a slideable manner, positive and negative contacts of the light fixture respectively come into contact with the contacts 107 of the contact ends 106 of the two conductive sheets 100, 101 through the two penetration holes 98 of the housing 90, to form electrical connection. Desirable elasticity of the contact ends 106 is to ensure desirable contact between electrode contacts of the light fixture and the two conductive sheets. Two electrical wires 124, 125 pass through an opening 121 of the lamp panel 120 and are respectively inserted in the jacks 95, 96 of the connector 80.

Figure 13:
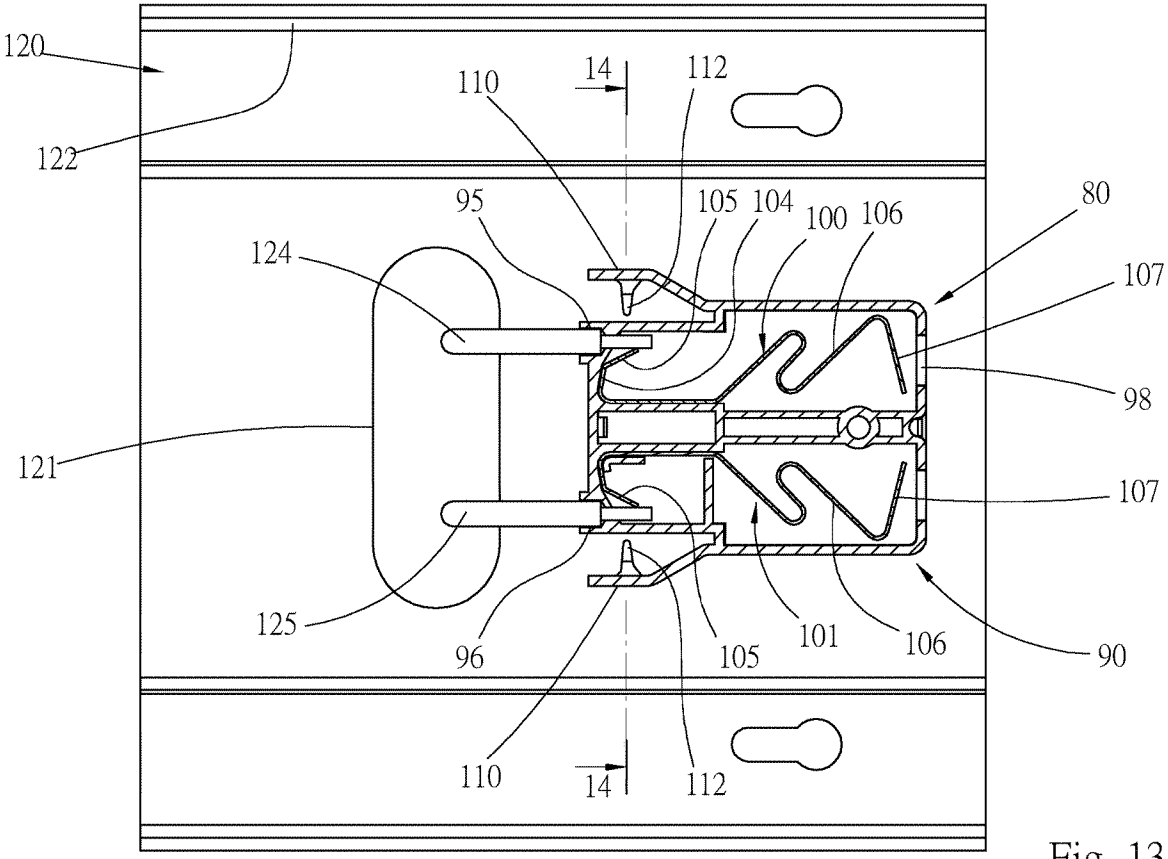
FIG. 13 is a sectional view along a sectional line 13-13 in FIG. 11, and shows an electrical wire being inserted in the connector.

Referring to FIG. 13, after the two electrical wires 124, 125 are inserted in the two jacks 95, 96, the two clamping sheets 105 are pressed and swing elastically, to allow the electrical wires to enter. In this way, the two electrical wires are electrically connected to the coupling ends 104 of the two conductive sheets 100, 101, are clamped by the two clamping sheets 105, and cannot be detached from the connector 80.

Figure 14:
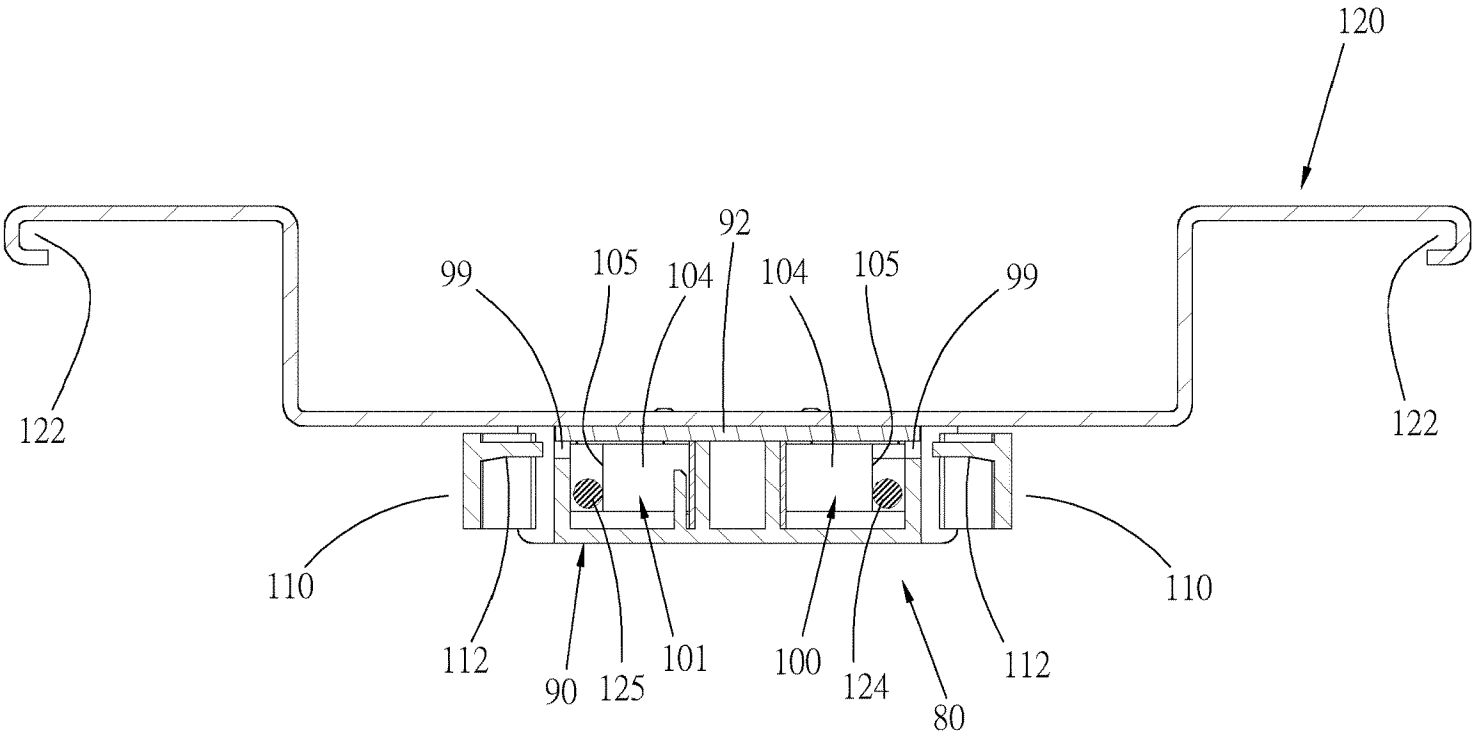
FIG. 14 is a sectional view along a sectional line 14-14 in FIG. 13.

When the two electrical wires need to be disconnected, referring to FIG. 14, only the two wire release buttons 110 need to be pressed to enable the push portions 112 of the wire release buttons 110 to extend into the housing 90 through the two through holes 99 and push the two clamping sheets 105 away from the two electrical wires 124, 125, so that the two clamping sheets no longer clamp the two electrical wires, and the two electrical wires can be easily pulled out from the connector.

Figure 15:
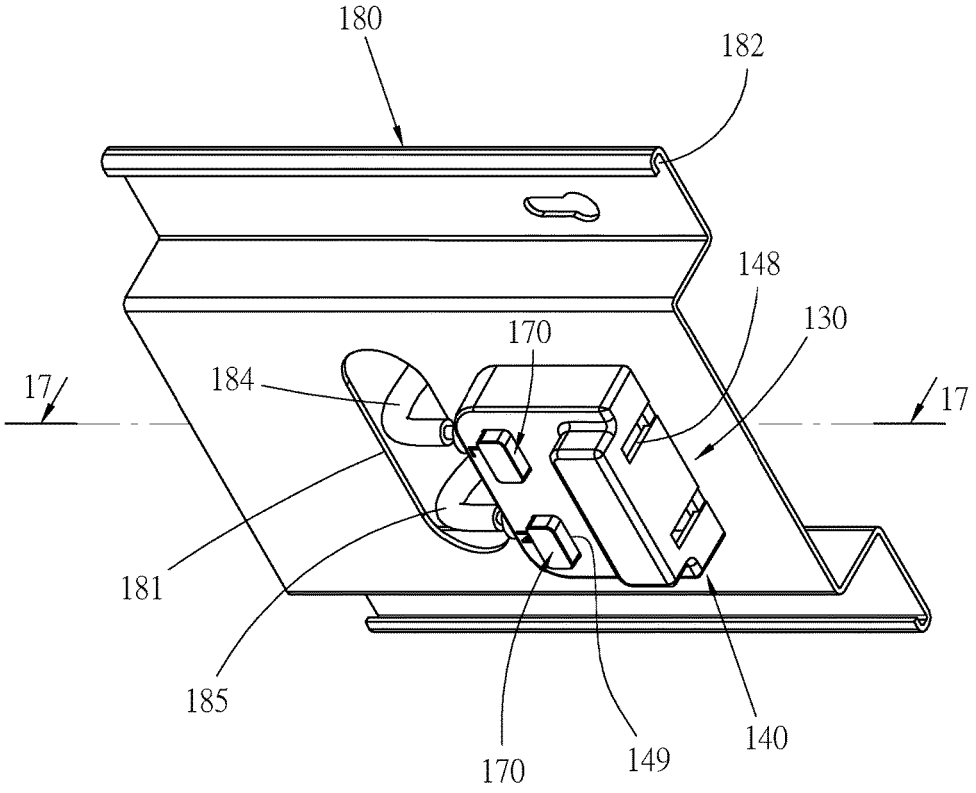
FIG. 15 is a three-dimensional view of a connector according to a third preferred embodiment of the present invention, and shows the connector being installed on a lamp panel.
Figure 16:
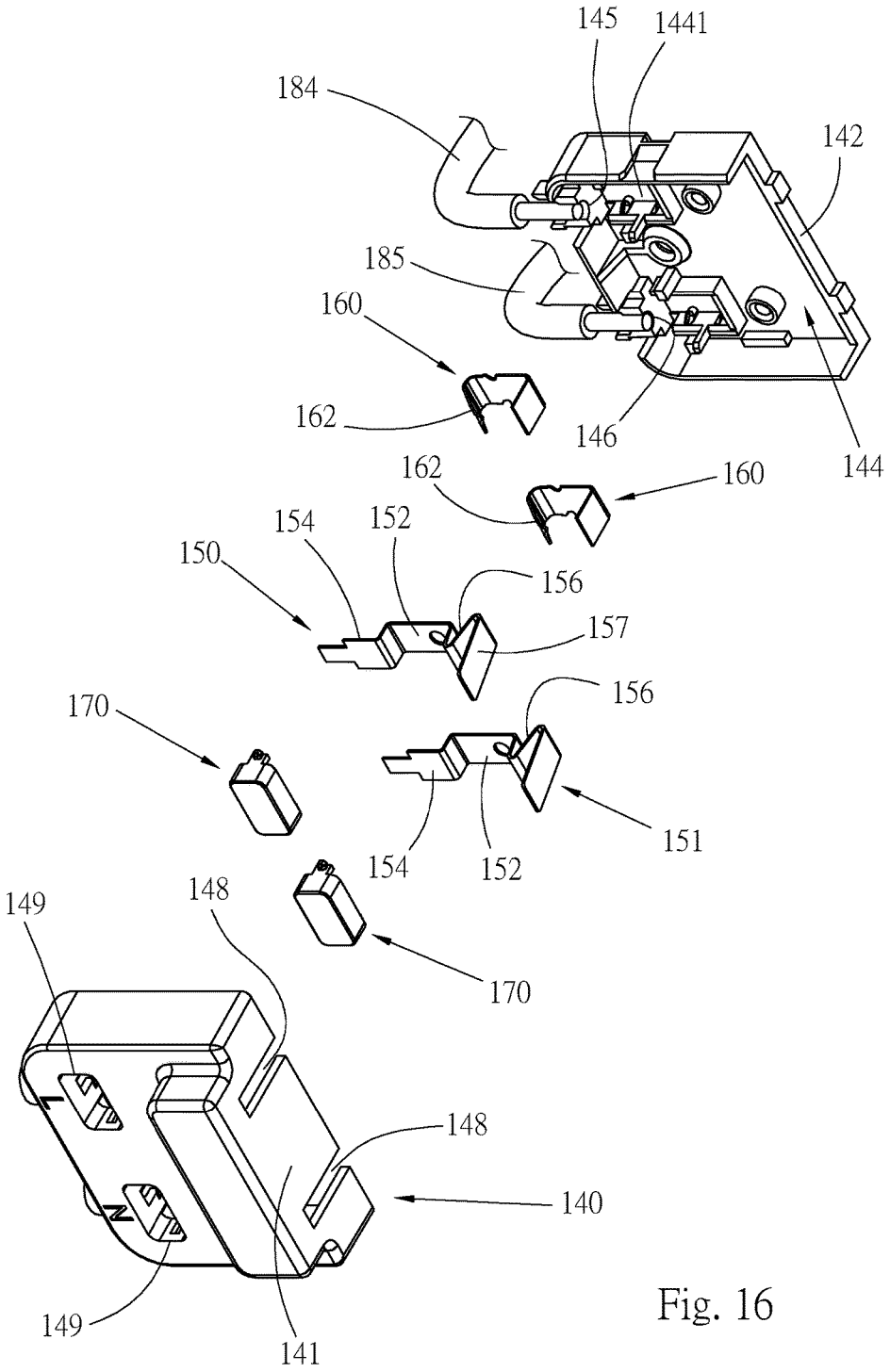
FIG. 16 is a three-dimensional exploded view of a large portion of FIG. 15.

FIG. 15 and FIG. 16 show a connector 130 according to the third preferred embodiment of the present invention. The connector 130 includes: a housing 140, a first conductive sheet 150, a second conductive sheet 151, and two wire release buttons 170. The figures show that the connector 130 is installed on a lamp panel 180.

The housing 140 has an upper housing 141 and a lower housing 142 fitting each other, and an installation space 144 formed between the upper housing and the lower housing. Two jacks 145, 146 are disposed at an end of the housing 140 and are connected to the installation space 144. Two penetration holes 148 are disposed at the other end of the housing 140, and are connected to the installation space 144. Two through holes 149 are disposed on a circumferential wall, for example, a front surface, on a side of the housing 140, are connected to the installation space 144, and correspond to the two jacks 145, 146. A rear surface of the lower housing 142 is connected to the lamp panel 180.

Each of the two conductive sheets 150, 151 has a body portion 152 and a coupling end 154 and a contact end 156 located at two ends of the body portion 152. The two conductive sheets 150, 151 are disposed in the installation space 144 in parallel. The two coupling ends 154 are respectively directly opposite inner ends of the two jacks 145, 146, and are both provided with an elastic clamping sheet 162. The two clamping sheets 162 are provided by two clamping members 160. The two clamping members 160 are respectively installed in two receiving grooves 1441 inside the installation space 144, and correspond to the two coupling ends 154. The clamping sheets 162 extend obliquely from the body portion 152 in a direction away from each jack, and are elastically displaceable when being pressed. Each contact end 156 extends outwardly in a manner of multiple bends from an end of the body portion 152. A contact 157 is formed at an end tip of the contact end 156. The contacts 157 of the two conductive sheets 150, 151 respectively correspond to the two penetration holes 148.

Figure 17:
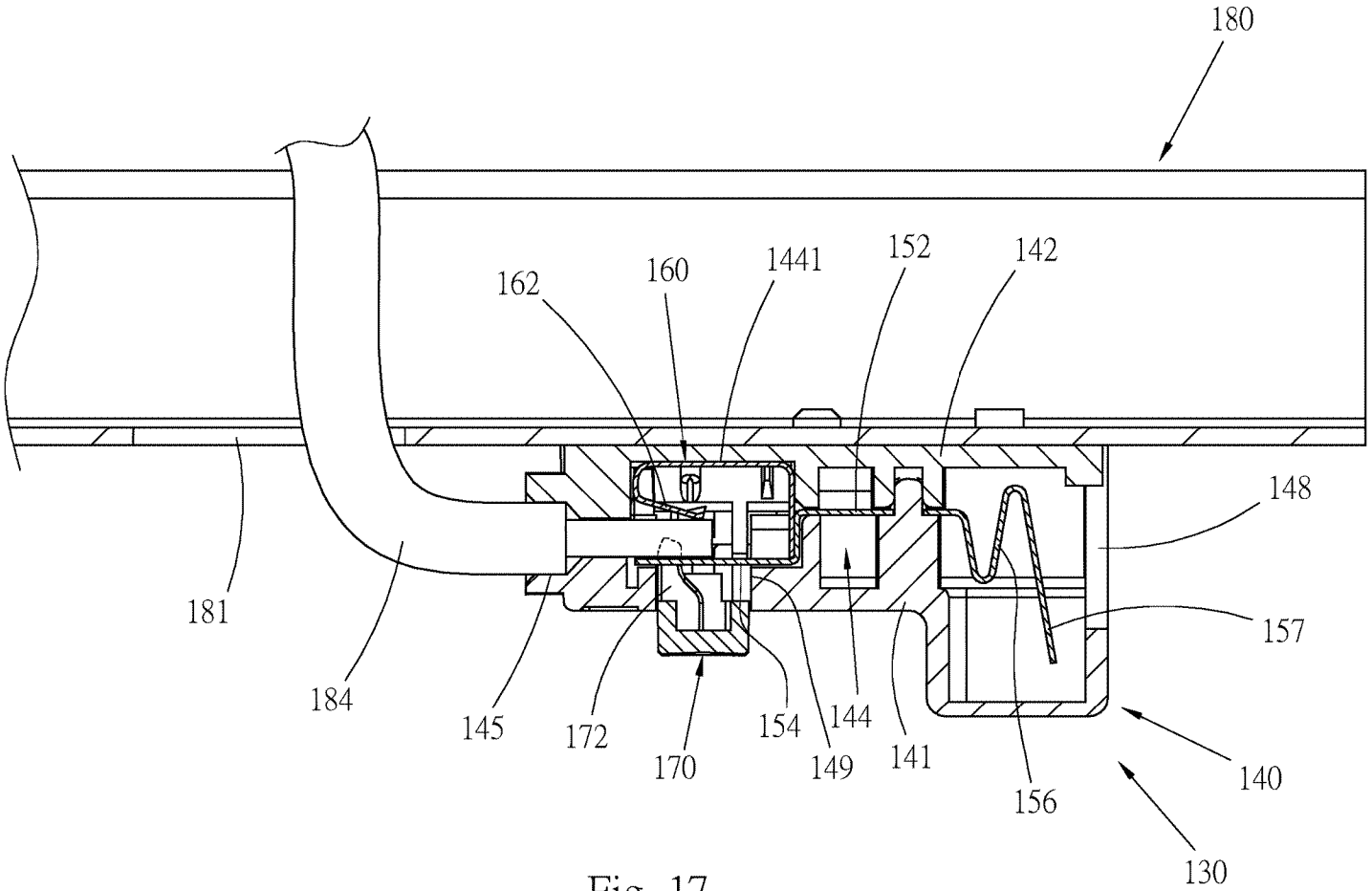
FIG. 17 is a sectional view along a sectional line 17-17 in FIG. 15.

The two wire release buttons 170 are disposed in the two through holes 149 of the housing 140 and are displaceable. Each wire release button 170 is provided with a columnar push portion 172. As shown in FIG. 17, when the two wire release buttons 170 are pressed, the push portions 172 of the wire release buttons 170 may push the clamping sheets 162 of the two conductive sheets 150, 151.

The lamp panel 180 is fixed on a wall surface. The penetration holes 148 of the connector 130 face an end of the lamp panel. Alight fixture (not shown), for example, a ceiling light, is slideably embedded in two parallel insertion slots 182 disposed on the lamp panel. Positive and negative contacts of the light fixture respectively come into contact with the contacts 157 of the contact ends 156 of the two conductive sheets 150, 151 through the two penetration holes 148 of the housing 140, to form electrical transmission. Desirable elasticity of the contact ends 156 is to ensure desirable contact between electrode contacts of the light fixture and the two conductive sheets. Two electrical wires 184, 185 pass through an opening 181 of the lamp panel 180 and are respectively inserted in the jacks 145, 146 of the connector 130.

Referring to FIG. 17, after the two electrical wires 184, 185 are inserted in the two jacks 145, 146, the two clamping sheets 162 are pressed and swing elastically. The two electrical wires are electrically connected to the coupling ends 154 of the two conductive sheets 150, 151, are clamped by the two clamping sheets 162, and cannot be detached from the connector 130.

When the two electrical wires need to be disconnected, only the two wire release buttons 170 need to be pressed, so that the push portions 172 of the wire release buttons 170 push the two clamping sheets 162 away from the two electrical wires 184, 185, so that the two electrical wires can be easily pulled out from the connector.

Figure 18:
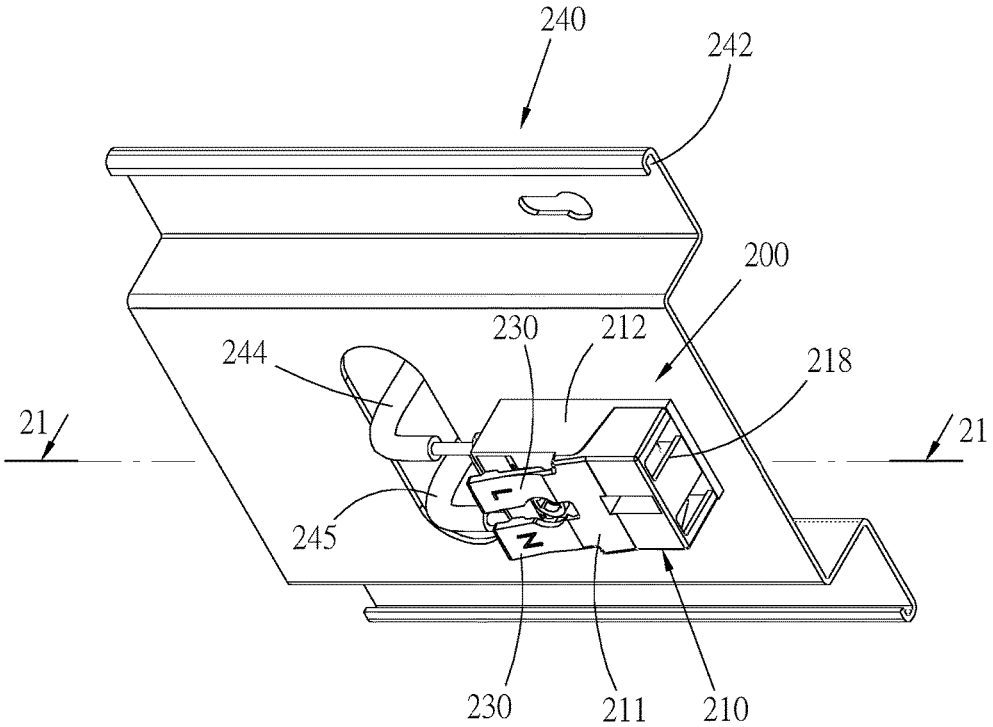
FIG. 18 is a three-dimensional view of a connector according to a fourth preferred embodiment of the present invention, and shows the connector being installed on a lamp panel.
Figure 19:
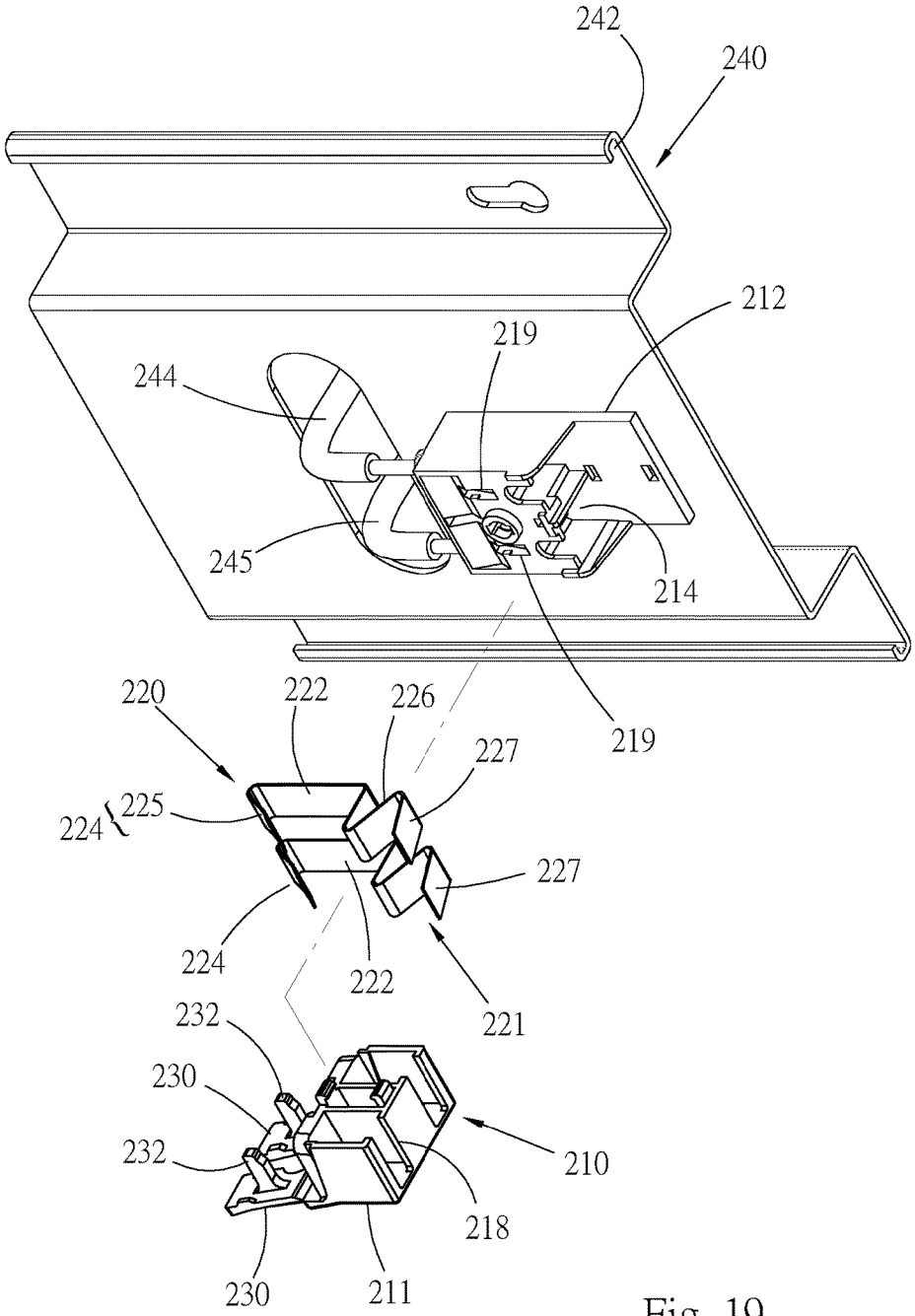
FIG. 19 is a three-dimensional exploded view of FIG. 18.

FIG. 18 and FIG. 19 show the fourth preferred embodiment of a connector 200 according to the present invention. The connector 200 includes: a housing 210, a first conductive sheet 220, a second conductive sheet 221, and two wire release buttons 230.

Figure 20:
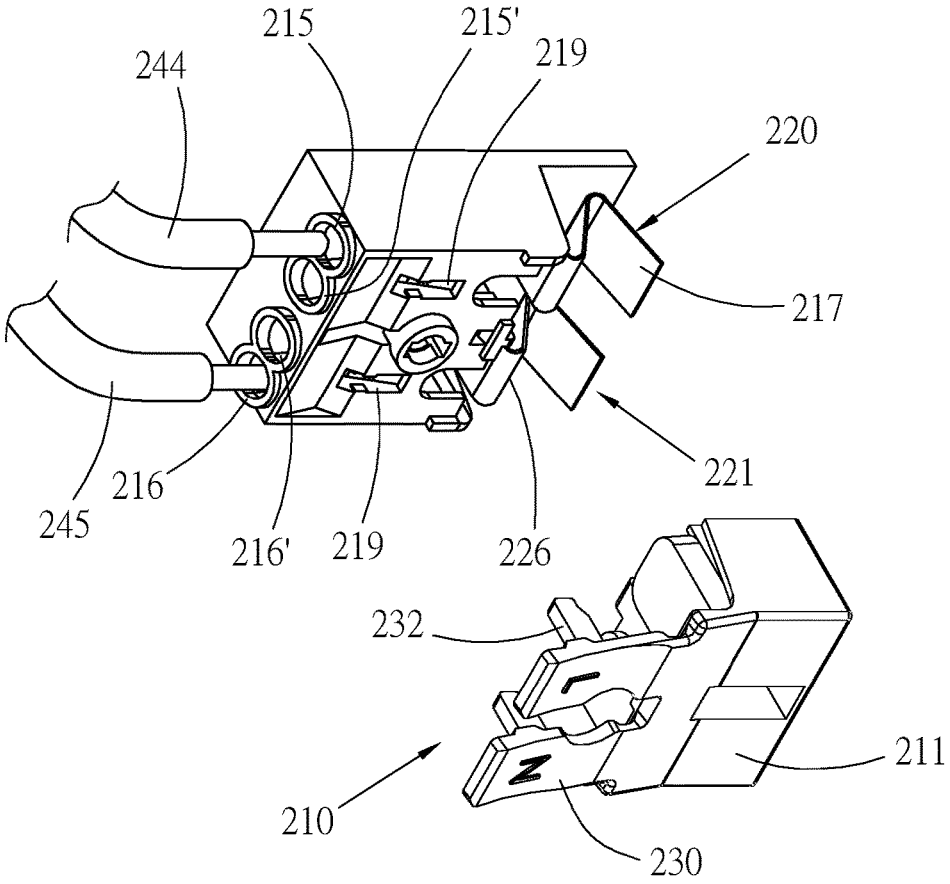
FIG. 20 is another three-dimensional view of the connector.
Figure 22:
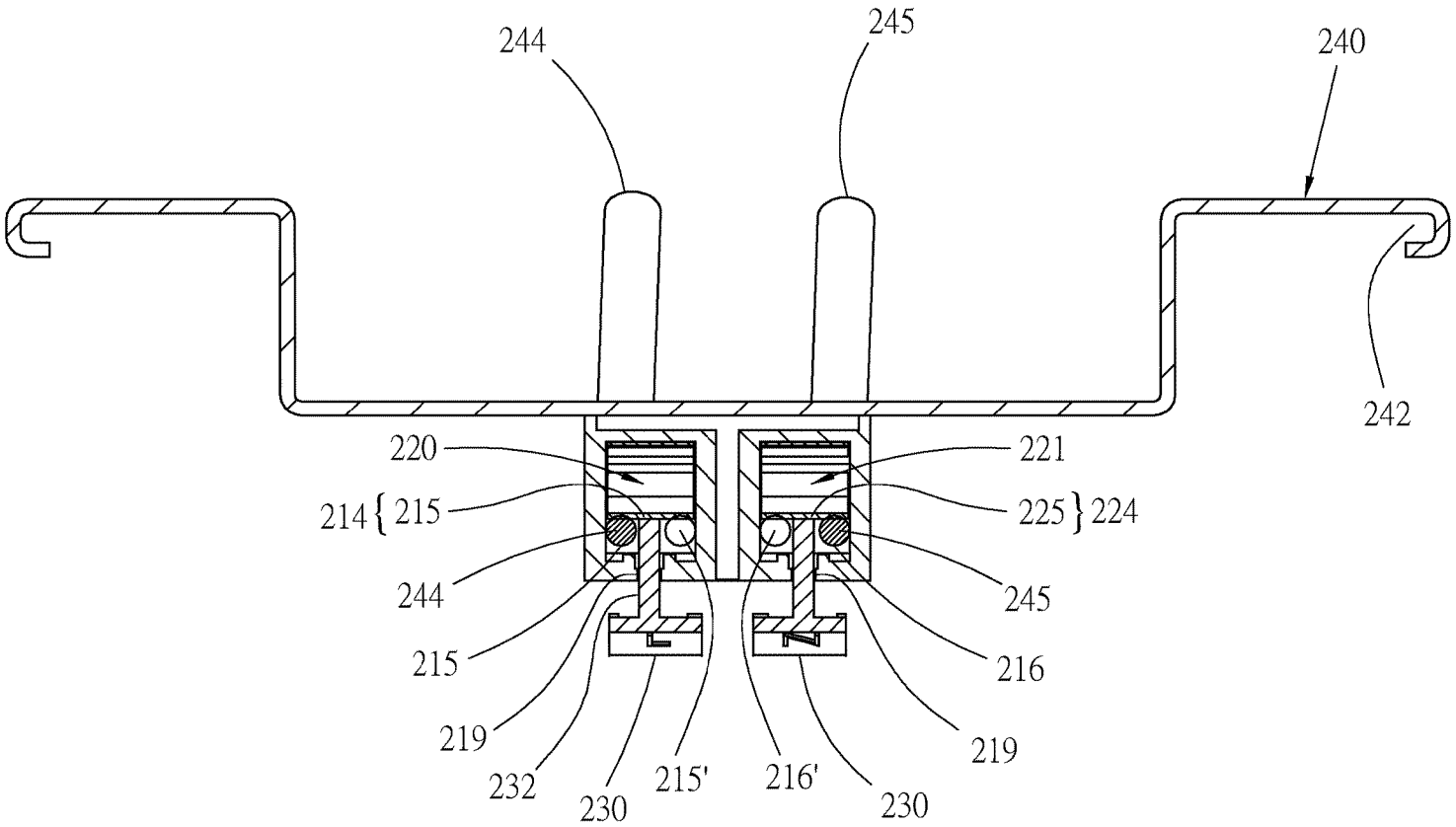
FIG. 22 is a sectional view along a sectional line 22-22 in FIG. 21.

The housing 210 includes an upper housing 211 and a lower housing 212 that may fit each other. An installation space 214 is formed between the upper housing 211 and the lower housing 212. At least two jacks 215, 216 are disposed at an end of the housing 210 (an end of the lower housing 212). Two penetration holes 218 are disposed at the other end of the housing 210 (an end of the upper housing 211). Two through holes 219 are disposed on a front surface of the housing 210 (a front surface of the lower housing), are connected to the installation space 214, and correspond to the two jacks 215, 216. The lower housing 212 is connected to a lamp panel 240. In this embodiment, four jacks are provided, as shown in FIG. 20. A pair of jacks 215, 215' are used for inserting an electrical wire 244, and another pair of jacks 216, 216' are used for inserting another electrical wire 245. Referring to FIG. 22, the through hole 219 on the left side is located between the pair of jacks 215, 215'. The through hole 219 located on the right side is located between the other pair of jacks 216, 216'.

Each conductive sheet 220 or 221 has a body portion 222 and a coupling end 224 and a contact end 226 located at two ends of the body portion. The two conductive sheets 220, 221 are disposed in the installation space 214. The two coupling ends 224 are respectively directly opposite inner ends of the two jacks 215, 216. Each coupling end 224 is provided with an elastic clamping sheet 225. The clamping sheet 225 extends obliquely from the body portion 222 in a direction away from each jack, and is elastically displaceable when being pressed. Each contact end 226 has desirable elasticity. A contact 227 is formed at an end tip of the contact end 226. The contact ends 226 correspond to the two penetration holes 218.

The two wire release buttons 230 are disposed at the housing 210 and are displaceable when being pressed. In this embodiment, the two wire release buttons 230 are integrally formed with the upper housing 211 and are elastically displaceable. An end of each wire release button 230 is connected to the housing. The other end of the wire release button 230 is a free end. Each wire release button 110 is provided with a columnar push portion 232. The two push portions 232 respectively extend into the installation space 214 through the two through holes 219. When the two wire release buttons 230 are pressed, the two push portions 232 may push the clamping sheets 225 of the two conductive sheets 220, 221.

The lamp panel 240 is fixed on a wall surface, for example, the ceiling. A light fixture (not shown) is embedded in insertion slots 242 on two sides of the lamp panel in a slideable manner. Positive and negative contacts of the light fixture respectively come into contact with the contacts 227 of the contact ends 226 of the two conductive sheets 220, 221 through the two penetration holes 218. The two electrical wires 244, 245 are respectively inserted in the jacks 215, 216 of the connector 200.

Figure 21:
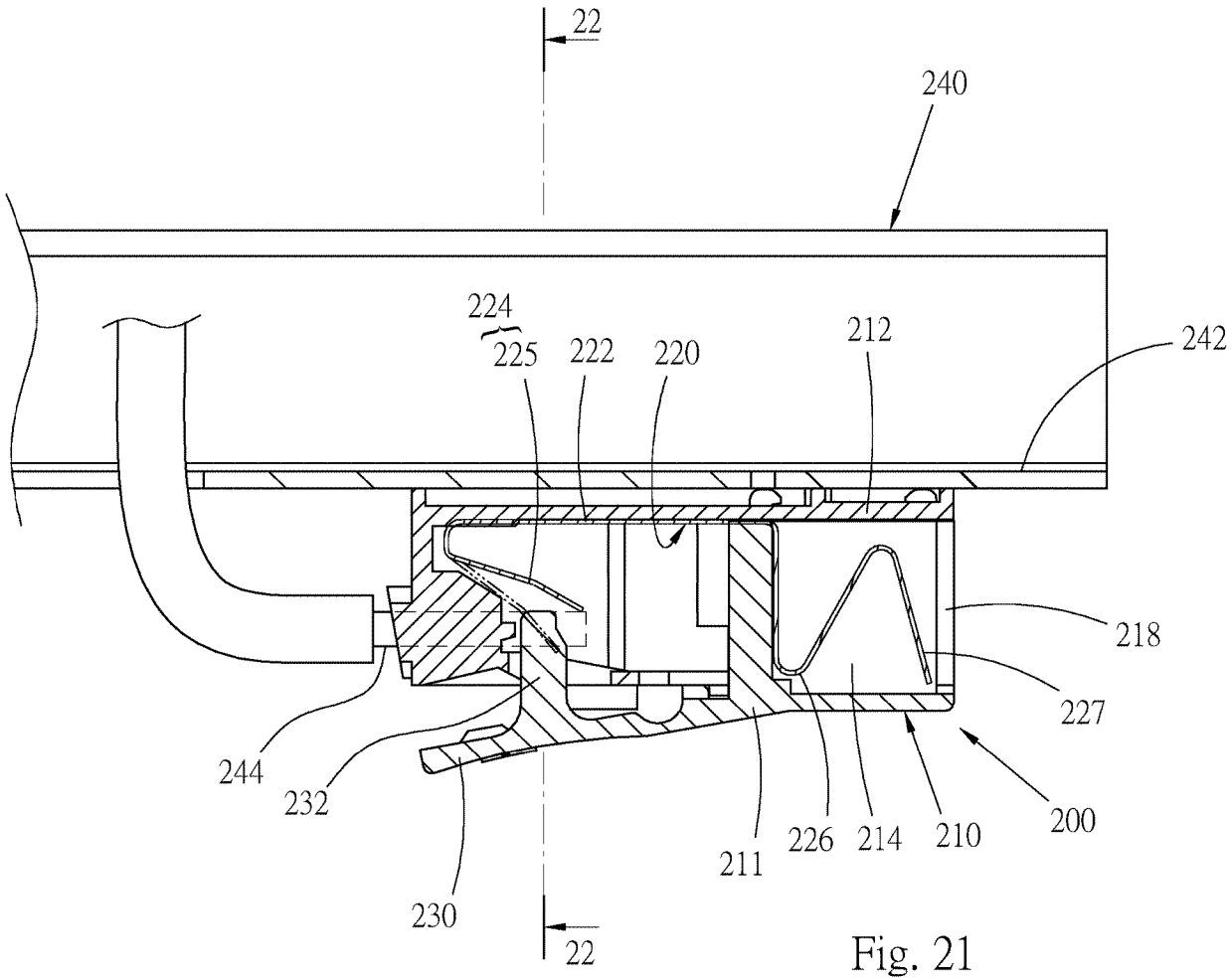
FIG. 21 is a sectional view along a sectional line 21-21 in FIG. 18, and shows an electrical wire being inserted in the connector.

Referring to FIG. 21 and FIG. 22, the two electrical wires 244, 245 are inserted to make the two clamping sheets 225 swing elastically. In this way, the two electrical wires are electrically connected to the coupling ends 224 of the two conductive sheets 220, 221, are clamped by the two clamping sheets 225, and cannot be detached from the connector 200.

When the two electrical wires are disconnected, the two wire release buttons 230 are pressed to enable the push portions 232 of the wire release buttons 230 to push the two clamping sheets 225 away from the two electrical wires 244, 245, so that the two clamping sheets no longer clamp the two electrical wires, and the two electrical wires can be easily pulled out from the connector. After the electrical wires are pulled out, each clamping sheet 225 elastically returns to the location shown by the phantom line from the location of the solid line in FIG. 21.

Figure 23:
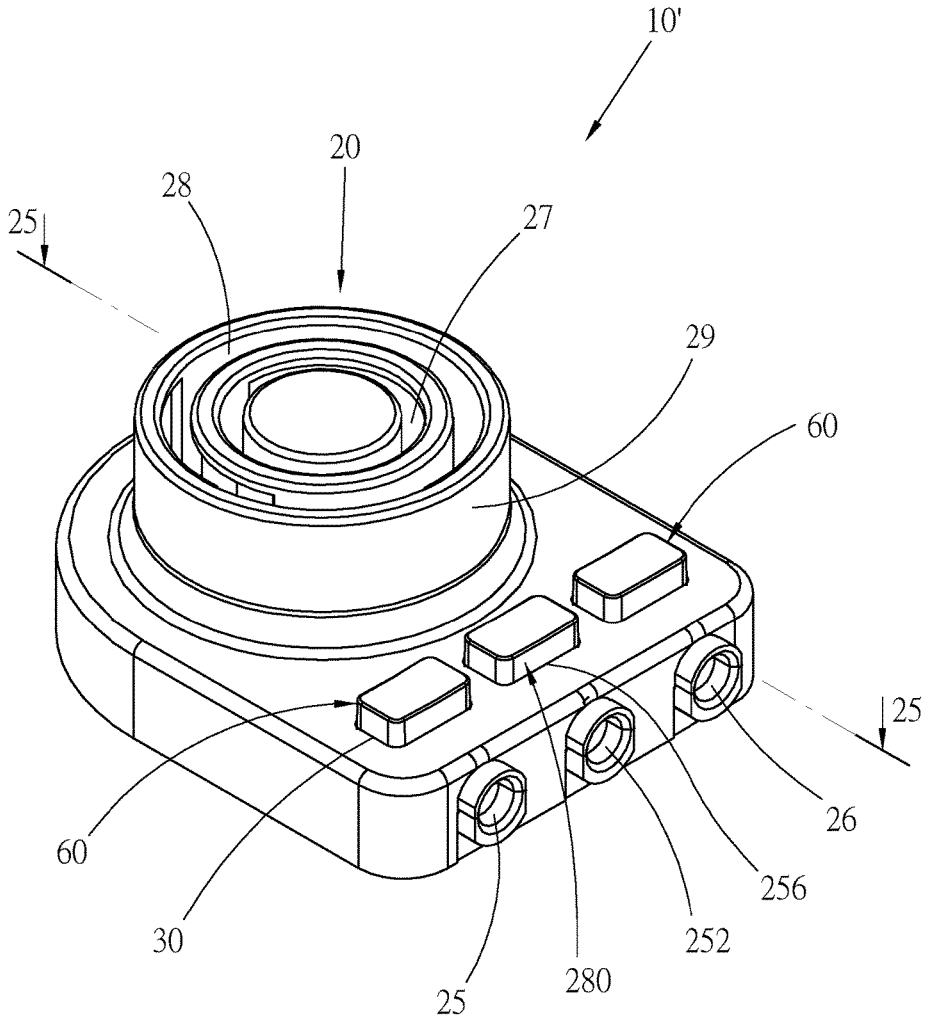
FIG. 23 is a three-dimensional view of a connector according to a fifth preferred embodiment of the present invention.
Figure 24:
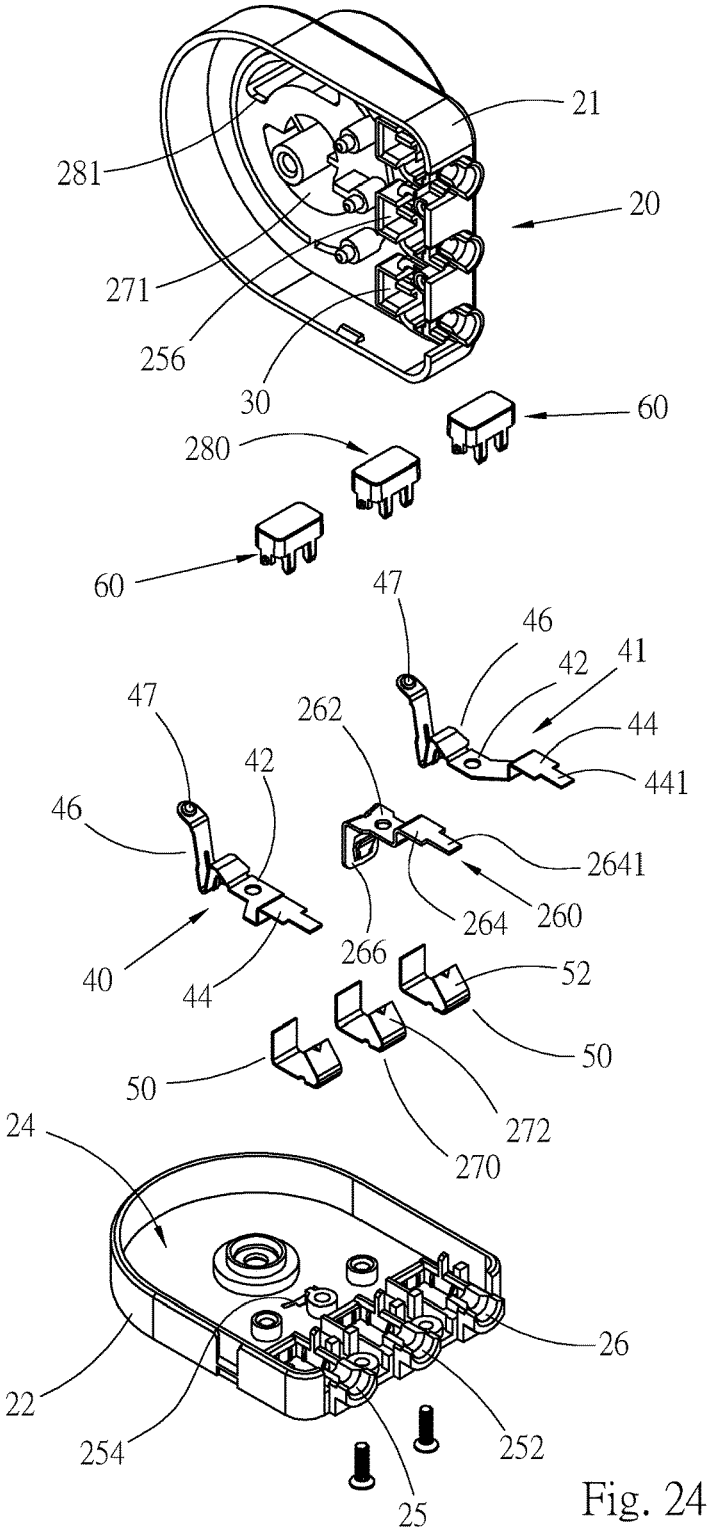
FIG. 24 is a three-dimensional exploded view of FIG. 23.
Figure 25:
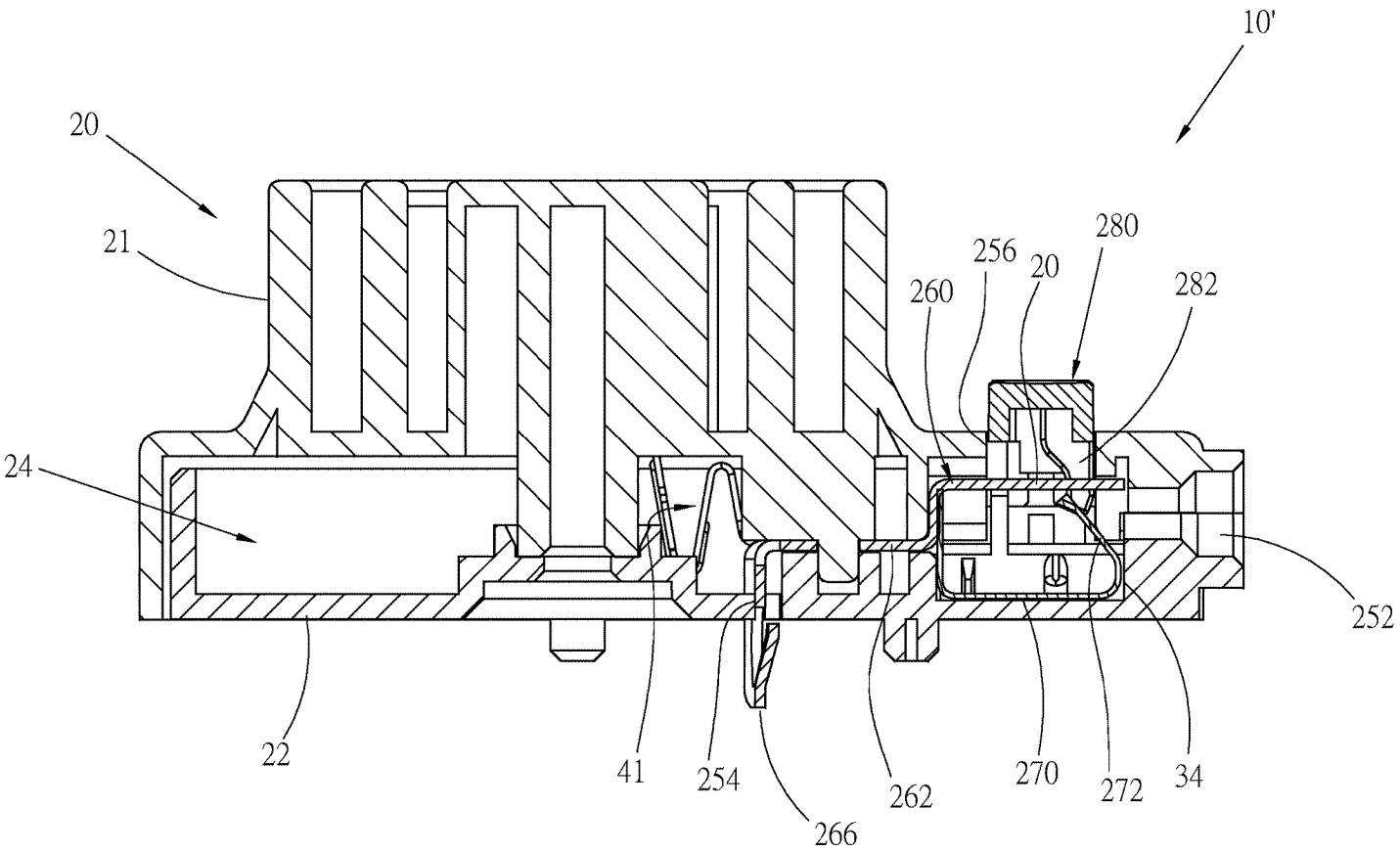
FIG. 25 is a sectional view along a sectional line 25-25 in FIG. 23.

FIG. 23 to FIG. 25 show a fifth preferred embodiment of a connector 10' according to the present invention. The connector in this embodiment is similar to the connector in the first preferred embodiment. Same numerals in the first preferred embodiment are used for the same members for understanding, and details are no longer described for conciseness.

The connector 10' is further provided with a third jack and a third conductive sheet. The third jack is a ground wire jack 252, is disposed at an end of the housing 20, and is connected to the installation space 24. The third conductive sheet is a grounded conductive sheet 260, and has a body portion 262 and a coupling end 264 and a connecting end 266 located at two ends of the body portion 262. Each coupling end 264 has an elastically swingable clamping sheet 272, so as to clamp a ground wire. The clamping sheet may be integrally formed with the conductive sheet 260. The clamping sheet 272 in this embodiment is provided by a third clamping member 270. The conductive sheet 260 and the clamping sheet 272 are correspondingly disposed in the housing. The coupling end 264 and the clamping sheet 272 are located at an inner end of the ground wire jack 252, and the clamping sheet 272 extends obliquely in a direction far away from the jack 252. The connecting end 266 of the conductive sheet 260 extends outside the housing through a hole 254 of the housing 20.

A third wire release button 280 is installed on a third through hole 280 of the housing 20. The structure of the third wire release button 280 is the same as the wire release button 60 in the first embodiment, and has a push portion 282, as shown in FIG. 25. Two feet (not shown) of the push portion 282 span a narrow portion 2641 of the coupling end 264 and may be held against the clamping sheet 272.

When the connector in this embodiment 10' is used, two electrical wires are inserted in the two jacks 25, 26 and are electrically connected to the first conductive sheet 40 and the second conductive sheet 41. A ground wire (not shown) may be inserted in the ground wire jack 252, is connected to the grounded conductive sheet 260, and is clamped by the clamping sheet 272. When the wire release button 280 is pressed, the push portion 282 may push the clamping sheet 272 away from the ground wire, so as to pull out the ground wire.

It may be understood that, the structures of the ground wire jack, the grounded conductive sheet, and the third wire release button provided in this embodiment may be implemented in the connectors in the second preferred embodiment to the fourth preferred embodiment.

For the connector provided in the present invention, no tool is needed to conveniently insert an electrical wire in the connector or pull out the electrical wire from the connector, so that it becomes more convenient to install or dismantle a light fixture, and it is especially convenient to install a ceiling light.

In addition, by means of the connector and the lamp panel provided in the present invention, the light fixture is easily assembled with the lamp panel, and the light fixture can be easily electrically connected to the connector.

What is claimed is:

1. A connector for a light fixture, comprising:

a housing, an installation space being formed in the housing; at least two jacks disposed at an end of the housing and connected to the installation space; a guide portion located on a wall surface of the housing;

a first conductive sheet and a second conductive sheet, wherein each conductive sheet has two ends, a coupling end and a contact end are respectively formed at the two ends, each coupling end has an elastically swingable clamping sheet, the two conductive sheets are disposed in the installation space of the housing, the two coupling ends respectively correspond to the two jacks, an end of each clamping sheet extends obliquely in a direction away from each jack, when an electrical wire is inserted in each of the jacks, the electrical wire is clamped by a clamping sheet; and the two contact ends are located at the guide portion; and two wire release buttons disposed at the housing and being displaceable, wherein the two wire release buttons respectively correspond to the coupling ends of the two conductive sheets, and when the two wire release buttons are pressed, the two clamping sheets may be pushed, to release a state in which the two clamping sheets clamp the electrical wire.

2. The connector according to claim 1, wherein each wire release button is provided with a push portion, and each clamping sheet is pushed by the push portion.

3. The connector according to claim 2, wherein the housing is provided with two through holes, connected to the installation space, and respectively corresponding to the two coupling ends, each wire release button is provided with a push portion, and the push portion extends into the installation space through each through hole, so as to push each clamping sheet.

4. The connector according to claim 3, wherein the two wire release buttons are integrally formed with the housing.

5. The connector according to claim 1, wherein the housing is provided with two through holes, connected to the installation space, and respectively corresponding to the two coupling ends, and the two wire release buttons are respectively installed in the two through holes, and are respectively displaceable in the two through holes.

6. The connector according to claim 1, further comprising:

a third jack disposed on the wall surface of the housing, and connected to the installation space; a third conductive sheet, wherein a coupling end and a connecting end are respectively formed at two ends of the third conductive sheet, each coupling end has an elastically swingable clamping sheet, the third conductive sheet is disposed in the installation space of the housing, the coupling end of the third conductive sheet corresponds to the third jack, and an end of the clamping sheet of the coupling end extends obliquely in a direction far away from the third jack; and a third wire release button disposed at the housing and being displaceable, and corresponding to the coupling end of the third conductive sheet, so that when the third wire release button is pressed, the clamping sheet of the third conductive sheet may be pushed.

7. The connector according to claim 6, further comprising: a third clamping member, disposed inside the installation space, and corresponding to the third conductive sheet, wherein the clamping sheet of the third conductive sheet is disposed at the third clamping member.

8. The connector according to claim 6, wherein the connecting end of the third conductive sheet extends outside the housing.

9. The connector according to claim 1, wherein an inner annular groove and an outer annular groove are concentrically formed on a circumferential surface of the housing, the two annular grooves are the guide portion, and the contact ends of the two conductive sheets are respectively located in the inner annular groove and the outer annular groove.

10. The connector according to claim 9, wherein a circumferential surface of the housing is provided with several concentrically disposed circular convex walls, the inner annular groove and the outer annular groove are formed between the circular convex walls, the inner annular groove and the outer annular groove are respectively connected to the installation space through a hollow portion, and the contact ends of the two conductive sheets respectively extend into the inner annular groove and the outer annular groove through the two hollow portions.

11. The connector according to claim 9, further comprising: a circular lamp panel, where the connector is installed on the lamp panel, and the inner annular groove and the outer annular groove are concentric with the lamp panel.

12. The connector according to claim 1, wherein the guide portion is two penetration holes disposed at an end of the housing and connected to the installation space, and the contact ends of the two conductive sheets respectively correspond to the two penetration holes.

13. The connector according to claim 12, further comprising: a lamp panel, wherein an insertion slot is provided on each of two sides of the lamp panel, the two insertion slots are parallel, the connector is installed on the lamp panel, and the two penetration holes face an end of the lamp panel.

14. The connector according to claim 1, further comprising: two clamping members, disposed inside the installation space, and respectively corresponding to the coupling ends of the two conductive sheets, wherein the two elastically swingable clamping sheets are respectively disposed at the two clamping members.

15. The connector according to claim 1, wherein the contact end of each conductive sheet has a configuration of multiple bends.

* * * * *